US005244025A

United States Patent [19]

Wewers

[11] Patent Number: 5,244,025

[45] Date of Patent: Sep. 14, 1993

[54] PROTECTIVE JACKETS FOR CHINAWARE

[76] Inventor: Molly F. Wewers, 9 Woodstock Ct., Little Rock, Ark. 72207

[21] Appl. No.: 748,432

[22] Filed: Aug. 22, 1991

[51] Int. Cl.[5] ..... B65D 65/02; B65D 65/06

[52] U.S. Cl. ..... 150/154; 206/553

[58] Field of Search ..... D6/610; 383/75, 117, 383/122, 901; 206/426, 553; 229/72; 150/154; D9/381, 341, 392, 392.1; D3/74, 75

[56] References Cited

U.S. PATENT DOCUMENTS

| | | | |
|---|---|---|---|
| 1,220,559 | 3/1917 | Riebe | 206/553 |
| 1,385,831 | 7/1921 | Hulbert | 383/122 X |
| 1,423,483 | 7/1922 | Ludlum | 206/553 |
| 1,650,393 | 11/1927 | Schaefer | 206/553 |
| 2,616,469 | 11/1952 | Katz et al. | 383/117 |
| 2,729,258 | 1/1956 | Pentland | 206/553 |
| 2,788,827 | 4/1957 | Banner | 206/553 |
| 2,952,510 | 9/1960 | Naken | 206/553 |
| 3,217,771 | 11/1965 | Skirow et al. | 206/426 |
| 3,405,863 | 10/1968 | Kugler | 383/75 |

FOREIGN PATENT DOCUMENTS

| | | | |
|---|---|---|---|
| 120832 | 7/1971 | Denmark | 229/72 |
| 1073381 | 1/1960 | Fed. Rep. of Germany | 206/553 |

OTHER PUBLICATIONS

"Lillian Vernon" Catalog, pp. 92 & 93 Items A–G, 1990 Lillian Vernon, Virginia Beach, VA 23479–0002.

"Lillian Vernon" Catalog, pp. 74 & 75 Items A–D & 6, Lillian Vernon, 510 S. Fulton Ave., Mount Vernon, NY 10550–5067.

*Primary Examiner*—Sue A. Weaver

*Attorney, Agent, or Firm*—Hill, Steadman & Simpson

[57] ABSTRACT

A protector for china is made of soft thick cotton flannel and has panel modules folded to form square layers and having over lock stitching to join edges together and to finish edges, thereby to form a jacket sleeve to encase and protect a piece of china selectively inserted into the jacket pocket.

7 Claims, 2 Drawing Sheets

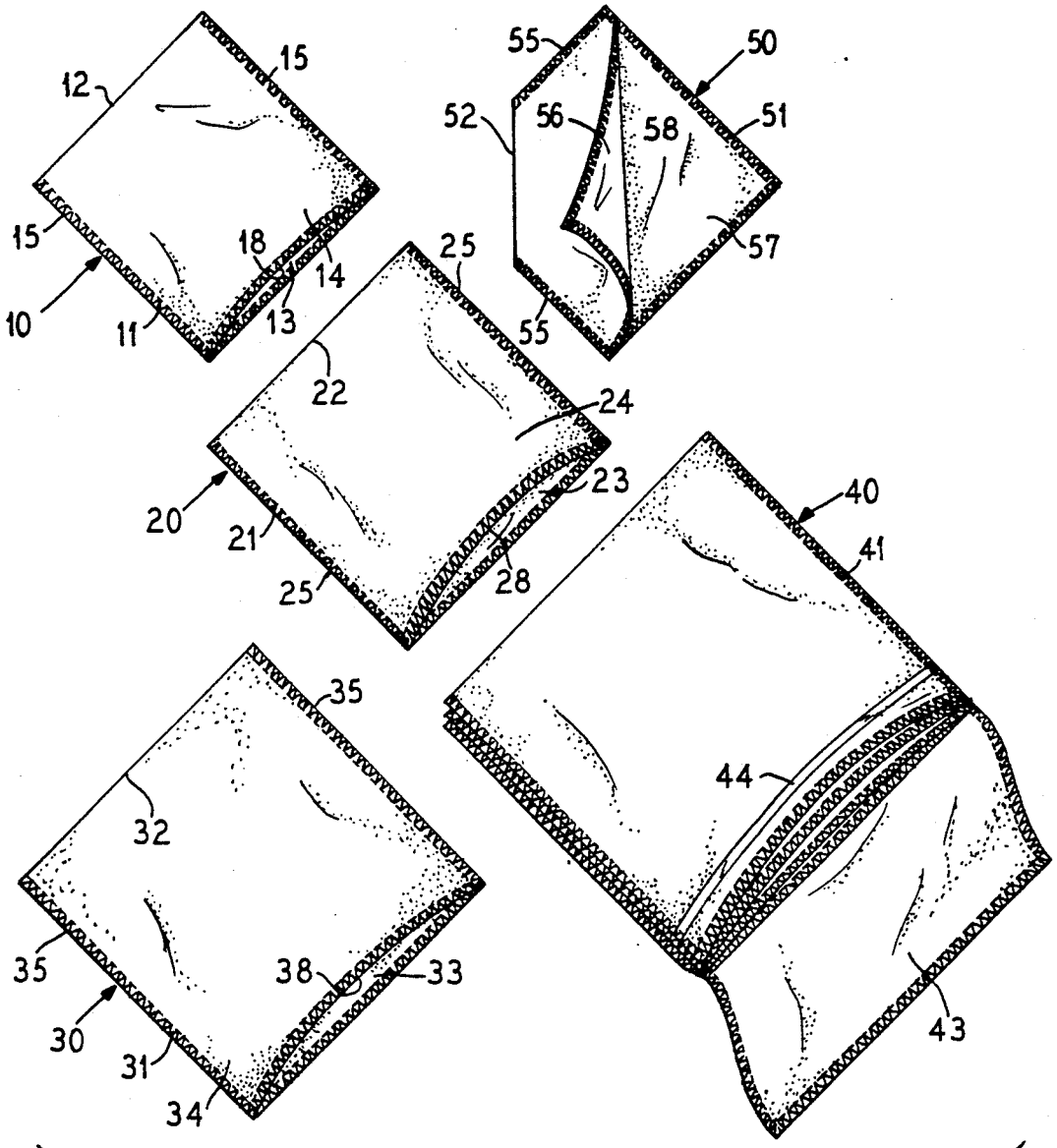
FIG. 1
FIG. 2
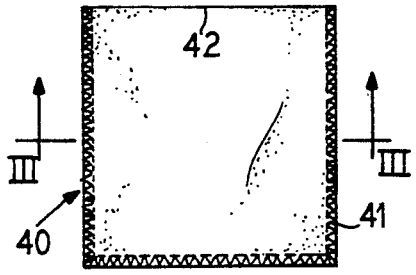
FIG. 3
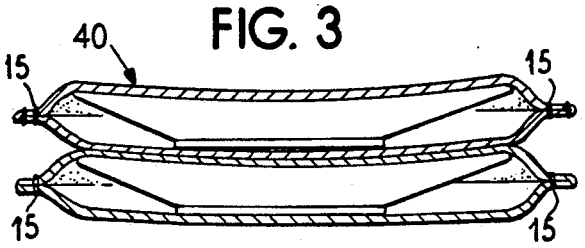

PROTECTIVE JACKETS FOR CHINAWARE

BACKGROUND OF THE INVENTION

1. Field of the Invention

This invention relates to protective items for china and more particularly relates to a chinaware jacket to encase and protect the chinaware by preventing it from knocking against other pieces.

2. Description of the Prior Art

Many middle and upper income households not only have everyday and fine china, but also holiday china, i.e., Christmas, Thanksgiving, etc. Proper storage when not in use is an ongoing problem. Many families have their china wrapped in tissue paper and packed in boxes or just stacked in a cabinet.

The prior art china protectors now on the market consist of vinyl zipper cases in which the pieces of china are stacked with a piece of paper or a piece of foam sheeting between them. Paper and foam compress and deteriorate with age and use.

SUMMARY OF THE INVENTION

The present invention is made of a fabric base consisting essentially of a soft and thick double faced flannel, from which modules are formed having edges that are fastened together and finished by means of an over lock stitching applied with a serger.

The modules, which can be sized selectively to fit different sizes of chinaware, are folded back upon one another to form squares, whereupon two of the free unfinished edges are joined or locked together and finished by means of over lock stitching leaving the other two free edges in an abutting relation with one another to form the opening or a throat of an opening into which a piece of china may be selectively inserted. Such other two free edges are also finished with over lock stitching.

Thus, the module functions as a jacket sleeve to encase and protect a piece of china inserted therein.

The modules may be used in special manners to form a container with one or more pockets, for example, or to dispose a pair of finished corner edges in such a manner as to form tucker flaps.

BRIEF DESCRIPTION OF THE DRAWINGS

FIG. 1 is a composite montage showing in elevation a plurality of the modularized elements of the present invention shaped, disposed and interconnected to provide the various forms of the inventive subject matter, and with parts of the modules positioned to show additional structural and functional features;

FIG. 2 is an elevational view of one form of the inventive subject matter;

FIG. 3 is a cross-sectional view taken on line III—III of FIG. 2;

DESCRIPTION OF THE PREFERRED EMBODIMENTS

Figure 4:
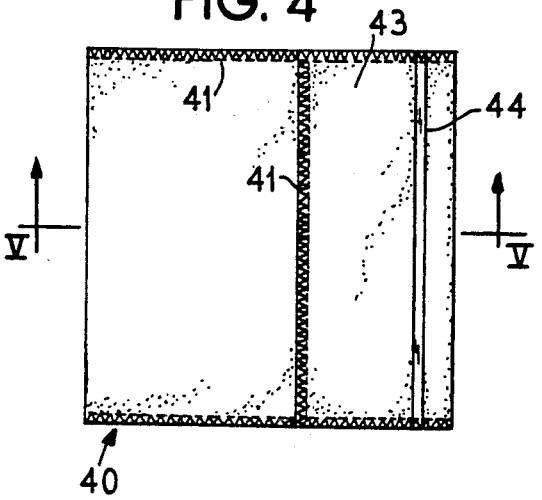
FIG. 4 is an elevational view of a multi-pocketed container formed in accordance with the present invention.

Referring to FIG. 1 of the drawings, a plurality of protectors embodying the principles of the invention are disclosed in the form of montage illustrating the versatility and adaptability of the inventive subject matter in accommodating protection for a variety of different forms of china ware.

Thus, there is shown a small size single pocket protector 10 which is approximately seven (7) inches square (about 17.5 mm) and which finds particular utility in protecting china pieces such as bread and butter plates, saucers and fruit bowls.

An intermediate size single pocket protector is shown at 20 which is approximately eight and one half (8.5) inches square (about 22 mm) and which finds particular utility in protecting china pieces such as salad plates and cereal bowls.

A large size single pocket protector is shown at 30 which is approximately twelve (12) inches square (about 30.5 mm) and finds particular utility in protecting china pieces such as dinner plates and rimmed soup plates.

In accordance with the principles of the present invention, a multi-pocketed container is shown at 40 which in the form of the illustration is approximately twelve (12) inches square (about 30.5 mm) and finds special utility in protecting either large plates or serving pieces and the like. A multi-pocketed container can also be made in the smaller sizes corresponding to the protectors 10, 20 and 30.

In order to protect items such as cups, sugar bowls and creamers, there is provided a protector 50 which is approximately the same size as the protector 10, differing therefrom in details of a tucker flap construction.

It is contemplated by the present invention that the protectors be made of luxurious cotton flannel for the softest, thickest protection of fine china. In order to accomplish that objective, I have determined that it is desirable to start with a fabric base constituting undyed, unbleached, dobby weave, double faced, flannel, one hundred percent (100%) cotton of thirteen and one half (13.5) ounces per running yard.

From such fabric base, there is formed panels of modules of different selected sizes either rectangular or somewhat diamond shaped, in order to afford the preforming of the different sizes of protectors 10, 20, 30, 40, and 50. Such panels of rectangular or geometric modules are conveniently formed by cutting from bolts of the prescribed material constituting the fabric base.

In order to finish the edges of the panels in those instances where the panel edges are pre-finished, the module has its edges finished with an over lock stitching shown in the protector 10 at 11 and in each of the other protectors by a reference numeral increased by one (1). In those instances where unfinished edges are joined together, they may be locked together and finished simultaneously by the use of over lock stitching.

The over lock stitching can be readily accomplished by use of a so-called serger, a machine which trims just ahead of the stitching, thereby providing a finely finished and trimmed edge.

The panel of the module, which may be generally rectangular (or diamond shaped for the cup protector 50), is folded back upon itself to form a square delineated by a bight portion 12 resulting from the multiple layers 13 and 14.

A first and a second pair of the adjoining unfinished free edges are interconnected by over lock stitching 15,15 while the other two of a third pair of adjoining free edges of the layers 13 and 14 cooperate with one another to form the mouth or throat of an opening 18 leading into a pocketed jacket sleeve and into which an appropriate piece of china may be inserted and by means of which the piece of china will be cushioned and protected while stored there within.

Each of the protectors 20 and 30 are similar in construction and function similar to the protector 10 and a corresponding sequence of reference numerals is used to identify the corresponding elements.

Referring to the protector 40 as shown in FIG. 1 and to the additional details of construction shown in FIGS. 2, 3, 4, 5, and 6, it is contemplated that a plurality of panel modules be integrated and joined together to form a multi-pocketed storage container. Thus, a plurality of completed modules constructed as defined in the description of the protectors 10, 20 and 30 are stacked and are joined together by simple stitching 45 (FIGS. 5 and 6) thereby to provide a multiple pocketed storage container for a plurality of china pieces.

In the formation of such a container-protector 40, the panel of the outermost module may be made selectively longer thereby to form an extending flap 43. A hold down strap or retainer strip 44 is fastened to the opposite module under which the flap 43 may be inserted, thereby permitting the flap 43 to form a closure over all of the openings in the various pockets of the container 40.

Figure 7:
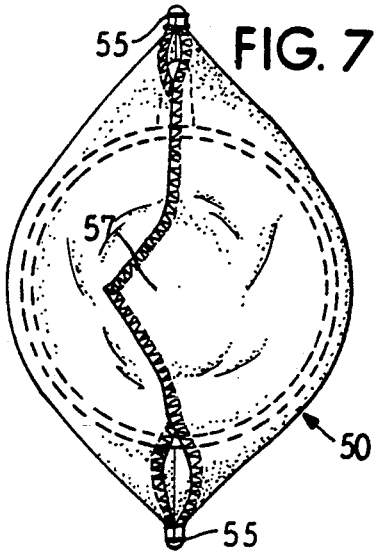
FIG. 7 is a top plan view of one of the modules with a piece of chinaware inserted into the jacket pocket and with the tucker flaps in place.
Figure 5:
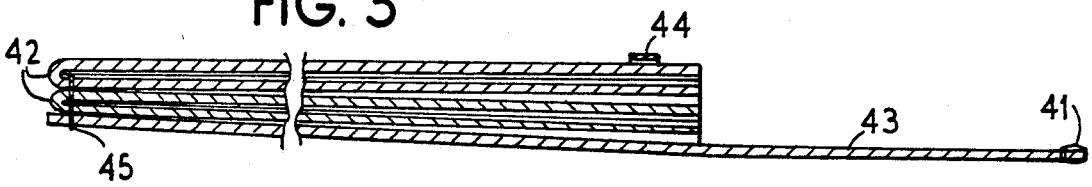
FIG. 5 is an enlarged broken cross sectional view taken on the plane of line V—V of FIG. 4 but showing the extension flap in the open position to illustrate additional details of construction.
Figure 6:
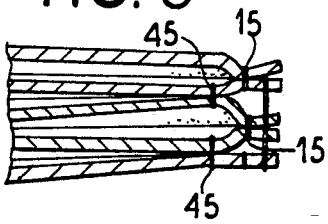
FIG. 6 is a fragmentary cross-sectional view showing details of the interconnections to join a plurality of modules.
Figure 8:
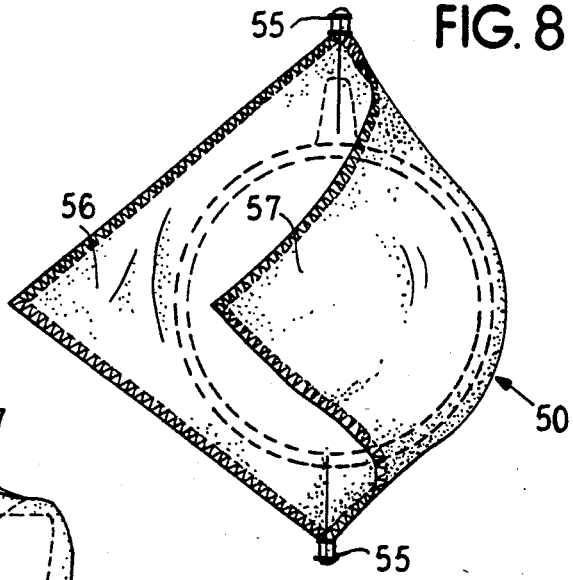
FIG. 8 is a view similar to FIG. 7 but with one of the tucker flaps folded to an open position.
Figure 9:
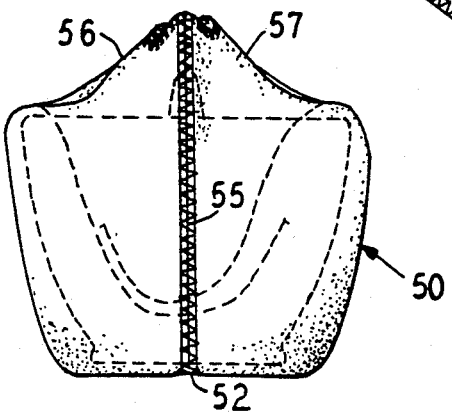
FIG. 9 is an end elevational view of the protector of FIG. 7.

Referring to the protector 50 of FIG. 1 in connection with the additional details of FIGS. 7, 8 and 9, it will be noted that a panel module of a somewhat diamond shaped module is disposed on the base fabric in such a manner that a bight portion 52 will be disposed on the bias of the fabric, rather than on the weave. By insuring that disposition, the cup-holder type protector 50 will stretch to accommodate the china piece inserted therein. A first pair of two adjoining free edges are interconnected and finished by over lock stitching as at 55,55 and a pair of corners with finished over locked stitched edges are provided which form tucker flaps 56 and 57 on opposite sides of a throat or mouth 58.

It should be understood that the principles of the present invention and the objectives of the present invention can be achieved even though there are variations in size or in the type of material used or in the specific form of stitching employed.

Although minor modifications might occur to those skilled in the art, it should be understood that I wish to embody within the scope of the patent warranted hereon all such modifications as reasonably and properly come within the scope of my contribution to the art.

I claim as my invention:

1. A protector comprising, a fabric base constituting undyed, unbleached, dobby weave, double faced, flannel, 100% cotton of 13.5 ounces per running yard;

panel modules cut from said fabric base, each said panel module having at least some of its edges finished with an over lock stitching, each said panel module being folded back upon itself at a bight portion to form multiple layers; and a first and a second pair of the adjoining free edges of the folded back panel module being interconnected to form a pocketed jacket sleeve extending from said bight portion to an opening disposed opposite said bight portion and with said opening lying between another pair of the adjoining free edges of the folded back panel module to engage and protect a piece of china selectively inserted therein;

said panel module being shaped and folded back upon itself in such a manner as to place two corners in a disposition to form tucker flaps lying on opposite sides of the opening between the other pair of adjoining free edges, thereby to protect cup shaped objects by tucking the flaps into the cup shaped object after it is inserted into the jacket sleeve.

2. A protector as defined in claim 1 wherein said bight portion is at the bias of the fabric so the protector will stretch when a cup-shaped article is inserted.

3. A protective jacket for cup-shaped chinaware comprising, a flannel panel with over lock stitching on at least some of the peripheral edges of the panel, said panel being shaped and folded over to form a pad with two unfinished edges joined together and finished with over lock stitching and two adjoining corners forming tucker flaps on opposite sides of an opening left between the edges of the pad;

whereby a cup-shaped piece of china may be inserted into the pad through the opening and the tucker flaps tucked into the piece of china thus inserted.

4. A protective jacket as defined in claim 3 wherein said panel is folded over at a bight portion on the bias of the fabric so the protector will stretch in use to accommodate the china.

5. A protective container for chinaware, comprising, a plurality of separate rectangular panels of double faced cotton flannel each finished on its edges with stitching to form a finished edging;

each of said panels being folded back upon itself to form an individual pocket and the thus folded panels being stacked to form multiple pockets with all opening disposed at one end and all bight portions disposed at the ends opposite thereto, stitching to lock the sides of the separate panels in firm assembly with one another;

the outer most of such panels having a wall of extended length to form a flap for overlying all of the openings; and a hold down strip fastened to said container under which said flap may be inserted to lock the flap in closed position;

whereby a plurality of chinaware pieces may be stored in said container without touching one another.

6. A protective container as defined in claim 5 and being further characterized by said cotton flannel constituting undyed, unbleached, dobby weave, 100% cotton of 13.5 ounces per running yard.

7. A protective jacket for chinaware comprising, a generally rectangular panel of soft, thick, double-faced, cotton flannel;

said panel being folded back upon itself at a bight portion to form a pad, the opposite side edges of the pad being joined together and finished with over lock stitching to form a jacketed sleeve or pocket with an opening opposite the bight portion and lying between a pair of adjoining free edges, thereby to receive and encase and protect a piece of china inserted there into, and over lock stitching finishing the edges of the pad adjacent said opening;

said panel being shaped and folded back upon itself in such a manner as to place two corners in a disposition to form tucker flaps lying on opposite sides of the opening between the pair of adjoining free edges, thereby to protect cup shaped objects by tucking the flaps in the cup shaped object after it is inserted into the jacket.

* * * * *